US006220683B1

(12) United States Patent
Chu

(10) Patent No.: US 6,220,683 B1
(45) Date of Patent: Apr. 24, 2001

(54) SLIDING TRACK ASSEMBLEY FOR DRAWER

(75) Inventor: Leo Chu, Taipei Hsien (TW)

(73) Assignee: Yin Da Slide Co., Ltd., Taipei Hsien (TW)

( * ) Notice: Subject to any disclaimer, the term of this patent is extended or adjusted under 35 U.S.C. 154(b) by 0 days.

(21) Appl. No.: 09/592,947

(22) Filed: Jun. 13, 2000

(51) Int. Cl.[7] ..... A47B 88/16
(52) U.S. Cl. ..... 312/334.44; 312/334.17; 312/334.11; 312/334.47; 384/18
(58) Field of Search ..... 312/334.1, 334.11, 312/334.7, 334.8, 330.1, 334.44, 334.47, 333, 334.17; 384/18, 21, 22

(56) References Cited

U.S. PATENT DOCUMENTS 5,316,389 * 5/1994 Hoffman ..... 384/18
5,484,209 * 1/1996 Weng ..... 384/18
5,542,759 * 8/1996 Krivec ..... 312/334.44
5,577,821 * 11/1996 Chu ..... 312/334.11
5,722,750 * 3/1998 Chu ..... 312/334.11
6,126,255 * 10/2000 Yang ..... 312/334.44 X

* cited by examiner

*Primary Examiner*—James O. Hansen
(74) *Attorney, Agent, or Firm*—Varndell & Varndell, PLLC

(57) ABSTRACT

A sliding track assembly includes an outer rail fixedly mounted inside a desk, an intermediate rail carried on a first sliding bearing and moved in and out of the outer rail, an inner rail carried on a second sliding bearing and moved with a drawer in and out of the intermediate rail, and a stop member installed in the intermediate rail to limit forward movement of the inner rail relative to the intermediate rail, wherein the stop member has two rear retaining frames for holding down the second sliding bearing when disconnecting the inner rail from the intermediate rail, the rear retaining frames each having an upright retaining wall for engagement with opposite side walls of the second sliding bearing, the upright retaining wall of each rear retaining frame having a raised portion adapted for engagement with a recessed portion on the respective side wall of the second sliding bearing, the upright retaining walls of the rear retaining frames being respectively spaced from the upright side walls of the intermediate rail by a gap, which enables the upright retaining walls of the rear retianing frames of the stop member to be respectively forced outwards to minimize friction resistance during loading of the inner rail with the drawer on the intermidiate rail.

2 Claims, 14 Drawing Sheets

SLIDING TRACK ASSEMBLEY FOR DRAWER

BACKGROUND AND SUMMARY OF THE INVENTION

The present invention relates to a sliding track assembly for drawer, and more particularly to a durable sliding track assembly, which produces less friction resistance during loading of the inner rail, and enables the inner rail to be quickly and easily loaded or unloaded.

U.S. Pat. No. 5,577,821 discloses a sliding track assembly for drawer. This structure of sliding track assembly is functional, however it still has drawbacks. As illustrates in FIGS. 1 and 2, the stop member comprises two retaining portions respectively backwardly protruded from two upright side blocks thereof for engagement with two side walls of the second sliding bearing to hold down the second sliding bearing in the intermediate rail when disconnecting the inner rail with the drawer from the intermediate rail, preventing the second sliding bearing from bearing pushed backwards or damaged when inserting the inner rail into the second sliding bearing in the intermediate rail to reload the drawer. The drawback of this design is that the retaining portions of the stop member wear quickly with use, and tend to be permanently deformed. When the retaining portions of the stop member start to wear, or are permanently deformed, the stop member can not positively hold down the second sliding bearing when disconnecting the inner rail with the drawer from the intermediate rail.

FIGS. 3 and 4 show a sliding track assembly according to U.S. Pat. No. 5,722,750. According to this design, the stop member comprises two backwardly extended rear locating plates adapted for holding down the second sliding bearing. The locating plates each have a beveled rear guide edge adapted to guide the second sliding bearing into engagement with the locating plates, and a notch extended through the respective two opposite side walls. The notch separates the rear end of the respective locating plate into an upper part and a lower part, and enables the upper part of the rear end of the respective locating plate to be forced downwards when the front positioning portions of the bottom wall of the second sliding bearing are moved into engagement with the locating plates. This design is still not satisfactory in function. The front positioning portions of the bottom wall of the second sliding bearing may be erroneously engageed into the notches the locating plates due to improper application of force, affecting normal functioning of the sliding track assembly.

The present invention has been accomplished to provide a sliding track assembly for drawer, which eliminates the aforesaid problems. In one embodiment of the present invention, the sliding track assebmly comprises an outer rail fixedly mounted inside a desk, an intermediate rail carried on a first sliding bearing and moved in and out of the outer rail, an inner rail carried on a second sliding bearing and moved with a drawer in and out of the intermediate rail, and a stop member installed in the intermediate rail to limit forward movement of the inner rail relative to the intermediate rail, wherein the stop member has two rear retaining frames for holding down the second sliding bearing when disconnecting the inner rail from the intermediate rail, the rear retaining frames each having an upright retaining wall for engagement with opposite side walls of the second sliding bearing, the upright retaining wall of each rear retaining frame recessed portion on the respective side wall of the second sliding bearing, the upright retaining walls of the rear retaining frames being respectively spaced from the upright side walls of the intermediate rail by a gap, which enables the upright retaining walls of the rear retaining frames of the stop member to be respectively forced outwards to minimize friction during loading of the inner rail with the drawer on the intermediate rail. In another embodiment of the present invention, the sliding track assembly sliding track assembly comprises on outer rail, an inner rail, a sliding bearing coupled between the outer rail and the inner rail, and a stop member installed in the outer rail, the stop member comprising two upright side blocks, which stop the sliding bearing from being moved out of the outer rail, two rear retaining frames adapter to hold down the sliding bearing when dosconnecting the inner rail with the second device from the outer rail, preventing the sliding bearing from being pushed backwards or damaged when inserting the inner rail into the sliding bearing in the outer rail to reload the drawer, the rear retaining frames of the stop member each comprising an upright retaining wall respectively backwardly extended from the upright side blocks of the stop member and adapted for engagement with two opposite side walls of the sliding bearing, a bottom retaining wall adapted for engagement with the front positioning portions of the bottom wall of the sliding bearing, and a longitudinal split disposed between the upright retaining wall and the bottom retainig wall for enabling the bottom retaining wall to be forced outwards to minimize friction resistance during loading of the inner rail with the drawer on the outer rail, the bottom retaining wall of each rear retaining frame of the stop member comprising a raised portion adapted for engagement with a recessed portion on the front positioning portions of the bottom wall of the sliding bearing.

DETAILED DESCRIPTION OF THE PREFERRED EMBODIMENT

Figure 1:
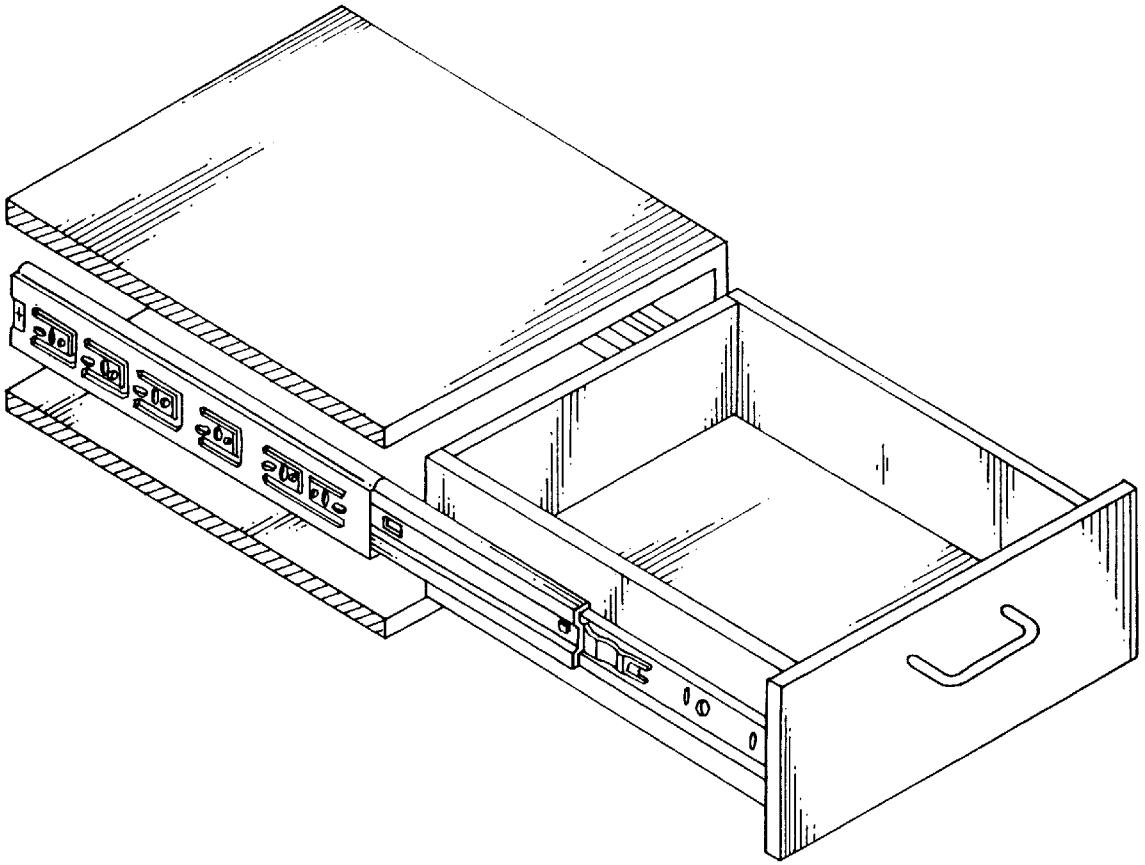
Fig. 1 PRIOR ART
FIG. 1 is a sliding track assembly installed in a drawer inside a cabinet according to U.S. Pat. No. 5,577,821.
Figure 2:
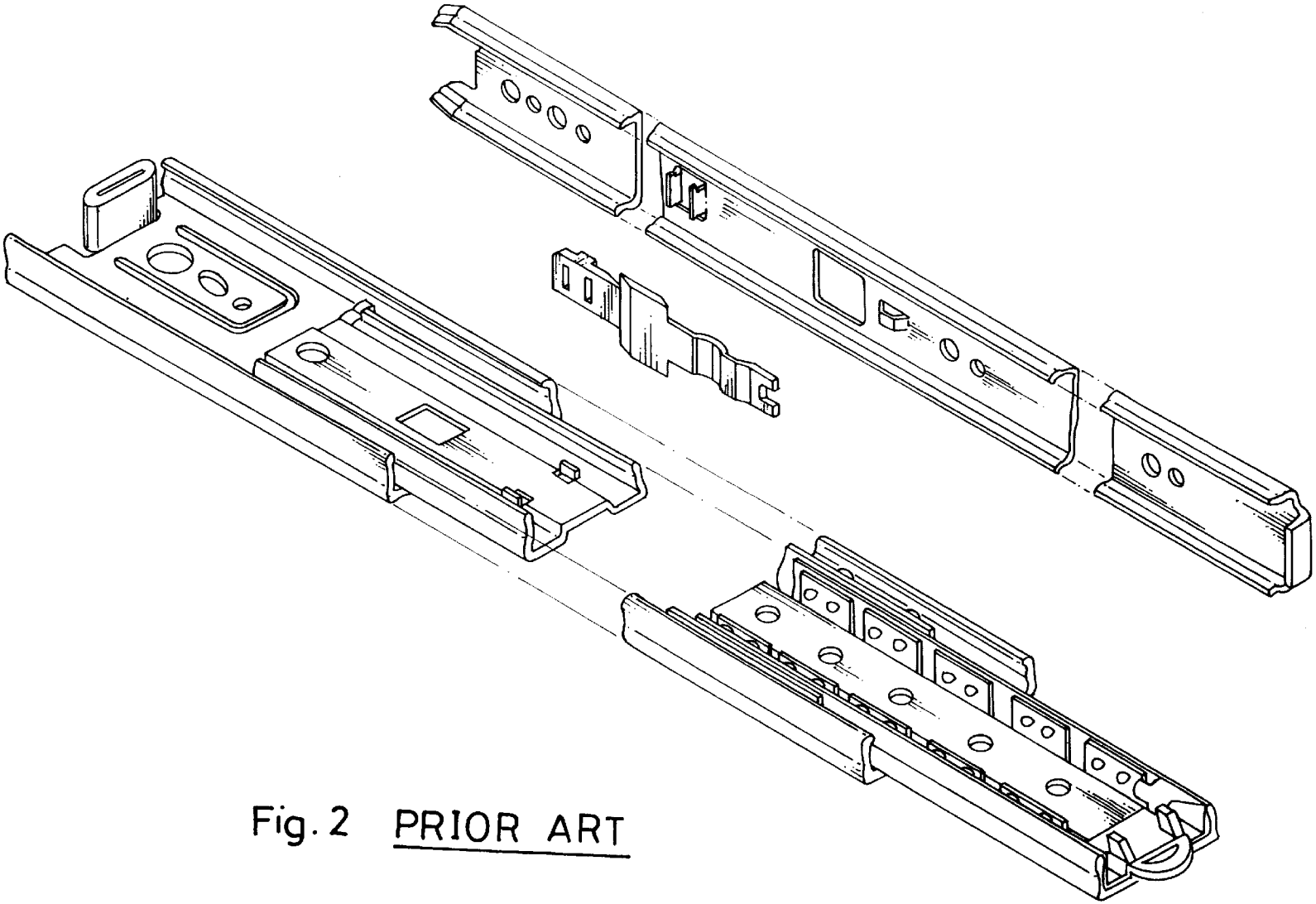
Fig. 2 PRIOR ART
FIG. 2 is an exploded view of the sliding track assembly according to U.S. Pat. No. 5,577,821.
Figure 3:
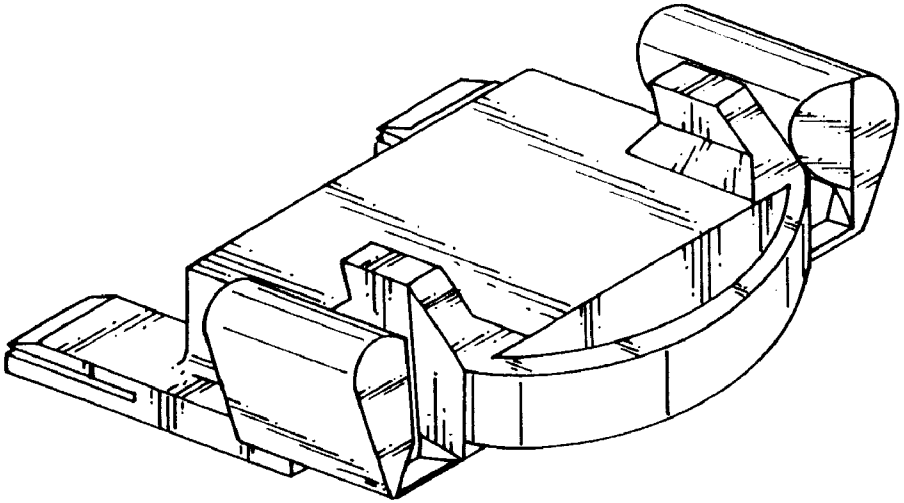
Fig. 3 PRIOR ART
FIG. 3 illustrates a stop member used in a sliding track assembly according to U.S. Pat. No. 5,722,750.
Figure 4:
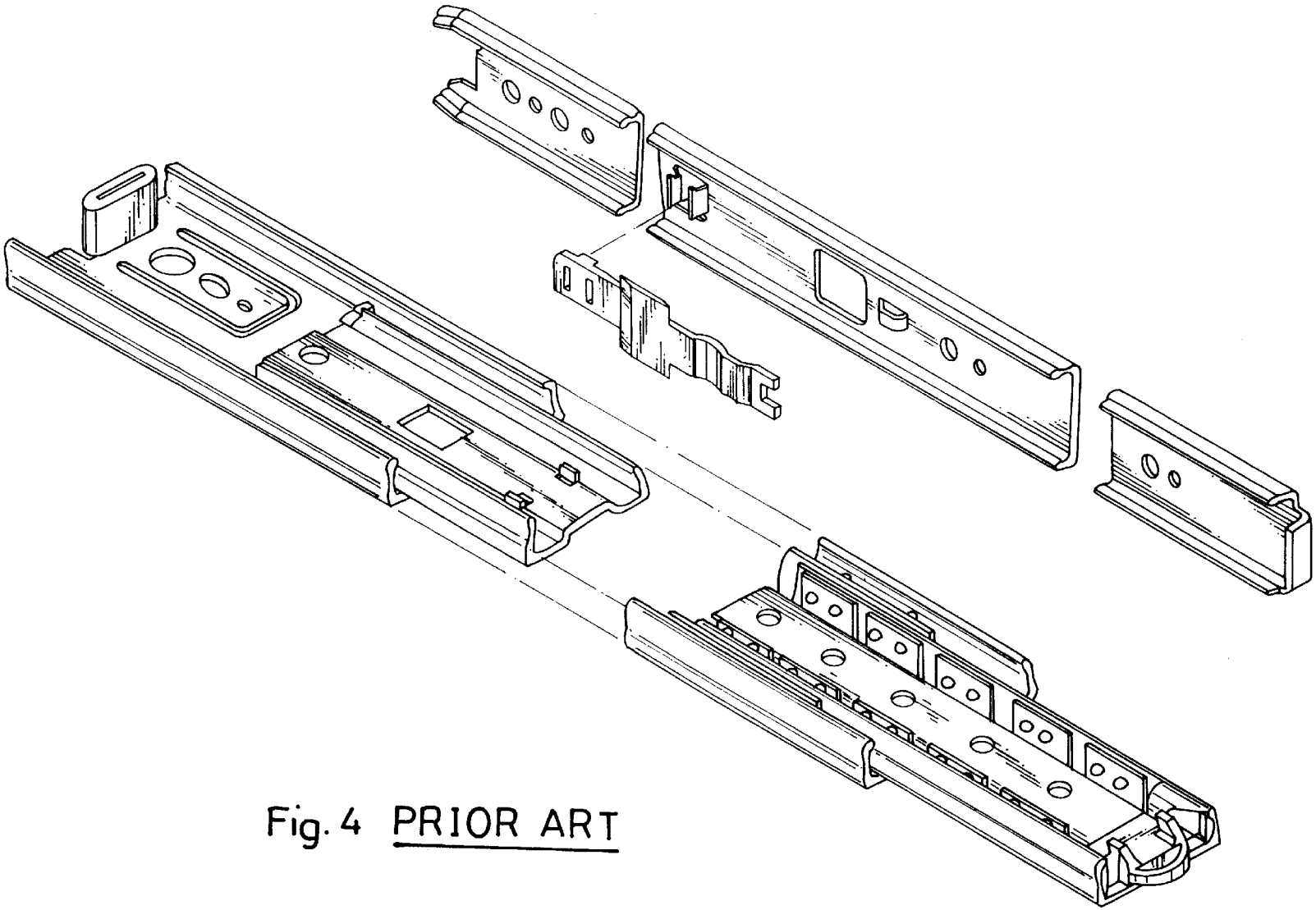
Fig. 4 PRIOR ART
FIG. 4 is an exploded view of a sliding track assembly, according to U.S. Pat. No. 5,722,750.

Referring to Figures from 5 through 10 , a sliding track assembly in accordance with the present invention comprises a locating plate 4, a stop member 5, an outer rail 6, an intermediate rail 7, an inner rail 8, a first sliding bearing 91 coupled between the outer rail 6 and the intermediate rail 7, and a second sliding bearing 92 coupled between the intermediate rail 7 and the inner rail 8. The outer rail 6 is fixedly fastened to the inside wall of, for example, a desk (not shown). The inner rail 8 is fixedly fastened to one lateral side wall of a drawer (not shown). The locating plate 4 is injection-molded from plastics, and fixedly fastened to the inner rail 8 near the rear end of the inner rail 8. The intermediate rail 7 is coupled between the outer rail 6 and the inner rail 8, and moved in and outer of the outer rail 6.

The stop member 5 is installed in the front end of the intermediate rail 7, comprising a protruding block 51 for engagement with the locating plate 4 to limit forward movement of the inner rail 8 in the intermediate rail 7, two upright side blocks 53 and 54, which stop the second sliding bearing 92 from being moved out of the front end of the intermediate rail 7, two rear retaining frames 55 and 56 bilaterally disposed at the rear side thereof and adapted to hold down the second sliding bearing 92 when disconnecting the inner rail 8 with the drawer from the intermediate rail 7, preventing the second sliding bearing 92 from being pushed backwards or damaged when inserting the rear end 81 of the inner rail 8 into the second sliding bearing 92 in the intermediate rail 7 to reload the drawer. The rear retaining frames 55 and 56 have a respective sloping guide edge 551 or 561 adapted to act with respective front positioning portions 923 and 924 of the bottom wall of the second sliding bearing 92, for enabling the second sliding bearing 92 to be moved into engagement with the rear retaining frames 55 and 56 when disconnecting the inner rail 8 with the drawer from the intermediate rail 7.

Figure 5:
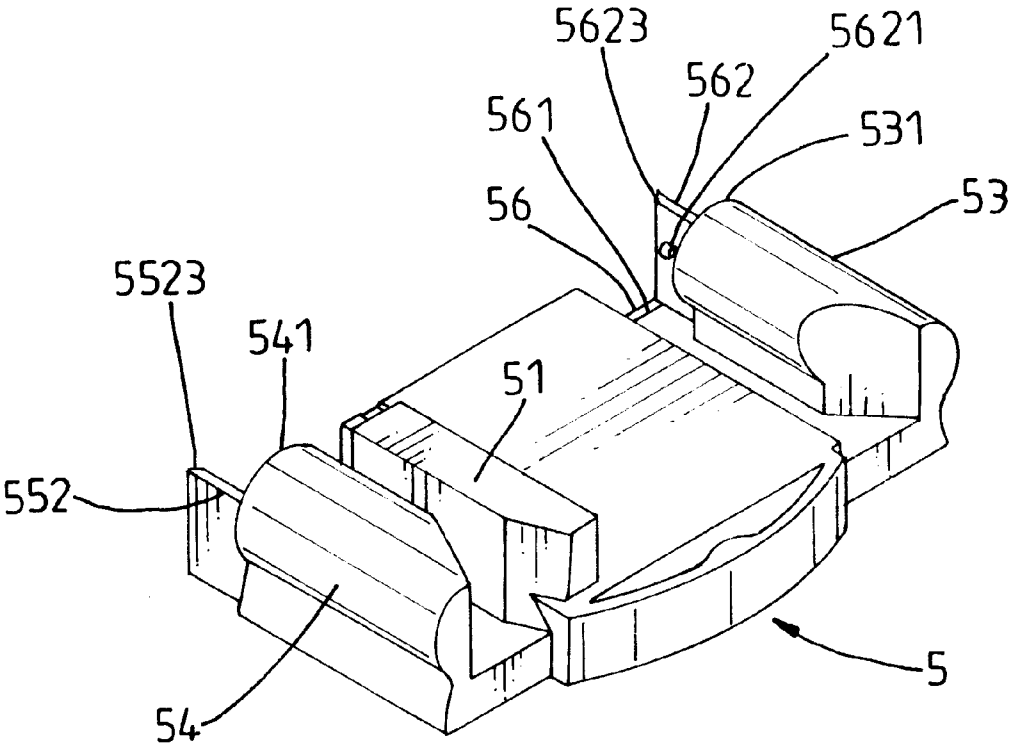
FIG. 5 illustrates a stop member for use in a sliding track assembly according to a first embodiment of the present invention.
Figure 6:
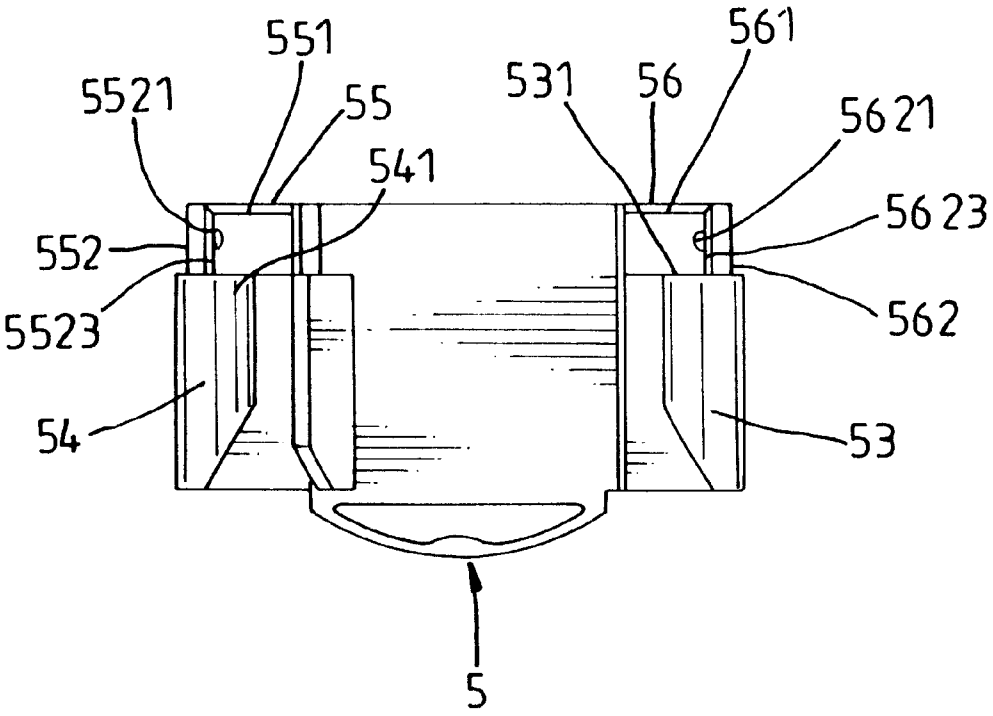
FIG. 6 is a stop plain view of the stop member shown in FIG. 5.
Figure 10:
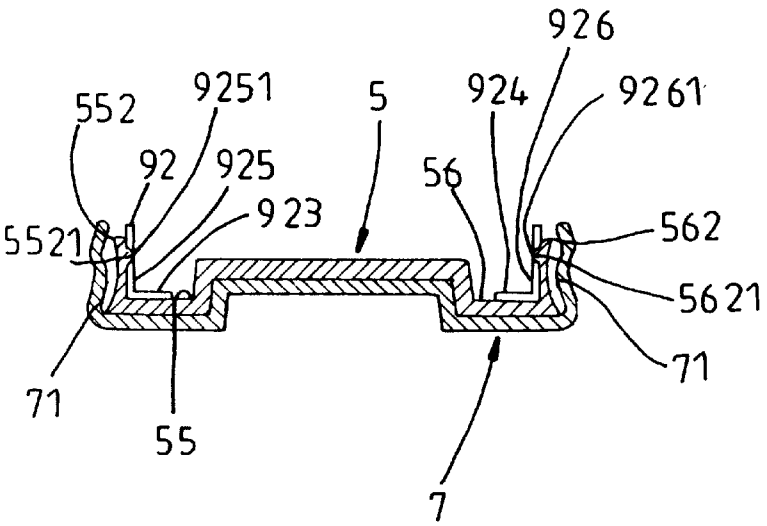
FIG. 10 is a cross sectional view in an enlarge scale of a part of FIG. 9, showing engagement between the stop member and the second sliding bearing.
Figure 7:
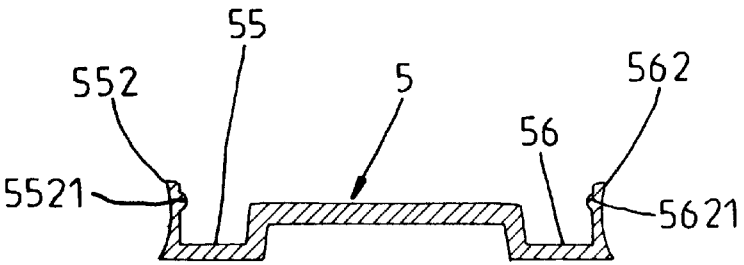
FIG. 7 is a cross sectional view of the stop member shown in FIG. 5.
Figure 8:
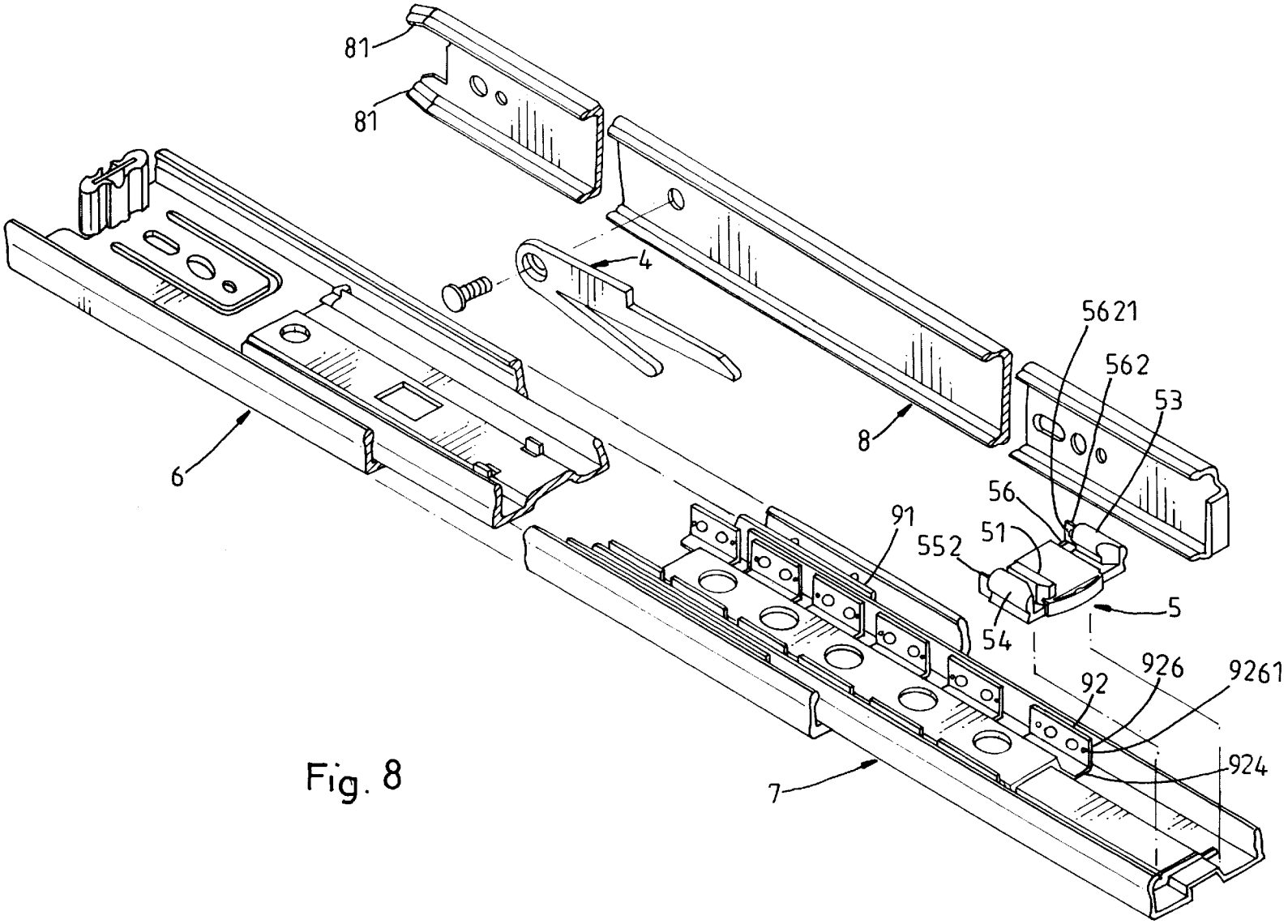
FIG. 8 is an exploded view of a sliding track assembly according to the first embodiment of the preset invention.
Figure 9:
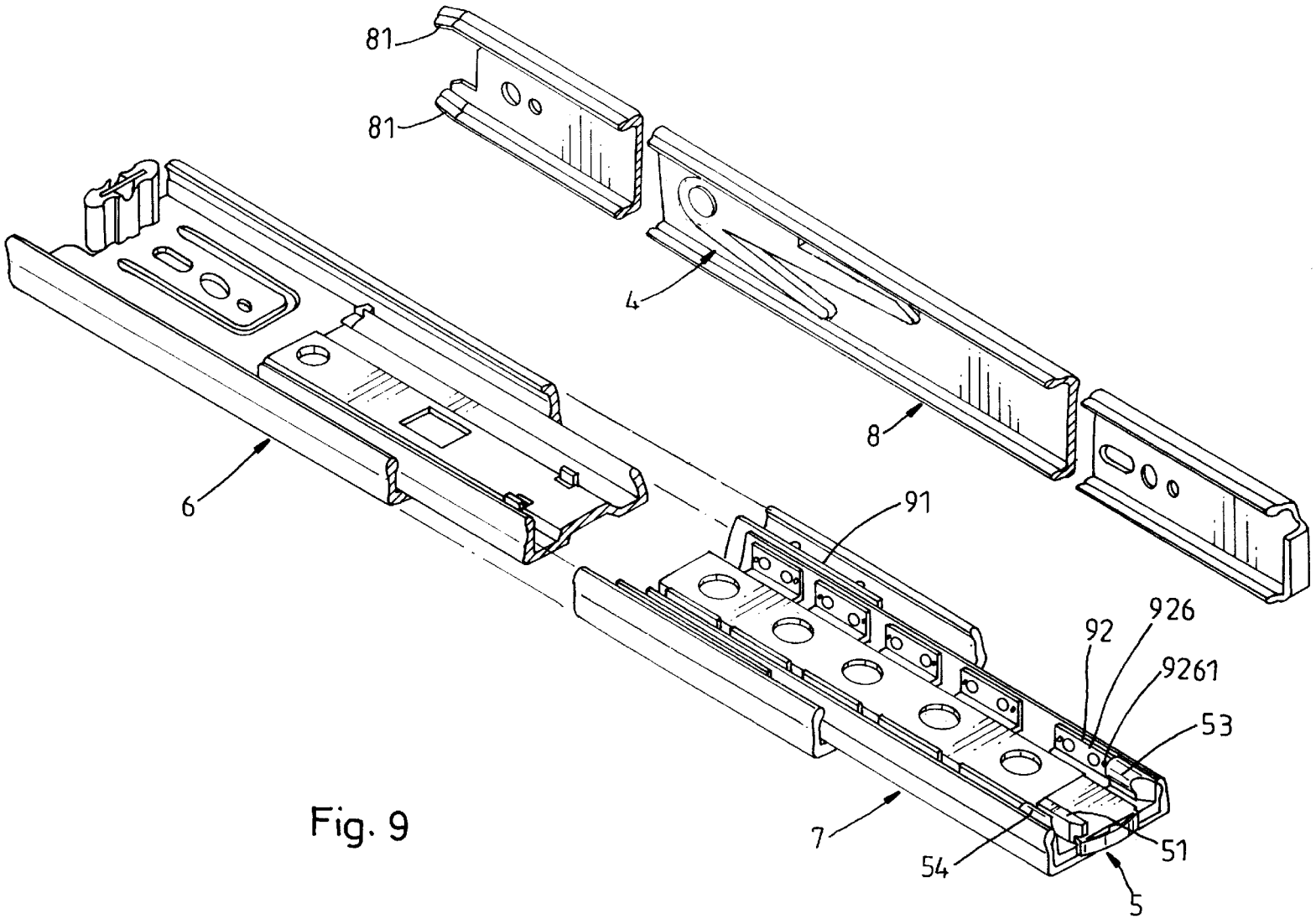
FIG. 9 is an assembly view of the sliding track assembly shown in FIG. 8 before the installation of the inner rail in the second sliding bearing in the intermediate rail.

The main characteristics of the present invention is outlined hereinafter with reference to Figures from 5 through 10 again. The retaining frames 55 and 56 each comprise an upright retaining wall 552 or 562 extended from the rear end 541 or 531 of the upright side block 54 or 53 adapted for engagement with two opposite side walls 925 and 926 of the second sliding bearing 92. The upright retaining wall 552 or 562 of the retaining frame 55 or 56 has a raised portion 5521 or 5621 adapted for engagement with a recessed portion 9251 or 9261 on the side wall 925 or 926 of the second sliding bearing 92. The upright retaining walls 552 and 562 of the rear retaining frames 55 and 56 of the stop member 5 have a certain thickness, and are respectively spaced from two upright side walls 71 of the intermediate rail 7 by a gap (see FIG. 10). The gap enables the upright retaining walls 552 and 562 of the rear retaining frames 55 and 56 of the stop member 5 to be respectively forced outwards to minimize friction resistance during loading of the inner rail 8 with the drawer on the intermediate rail 7. The upright retaining walls 552 and 562 of the rear retaining frames 55 and 56 of the stop member 5 each have a beveled guide edge 5523 or 5623 (see FIGS. 5 and 6) adapted for guiding the side walls 925 and 926 of the second sliding bearing 92 in and out of the rear retaining frames 55 and 56 of the stop member 5.

Figure 11:
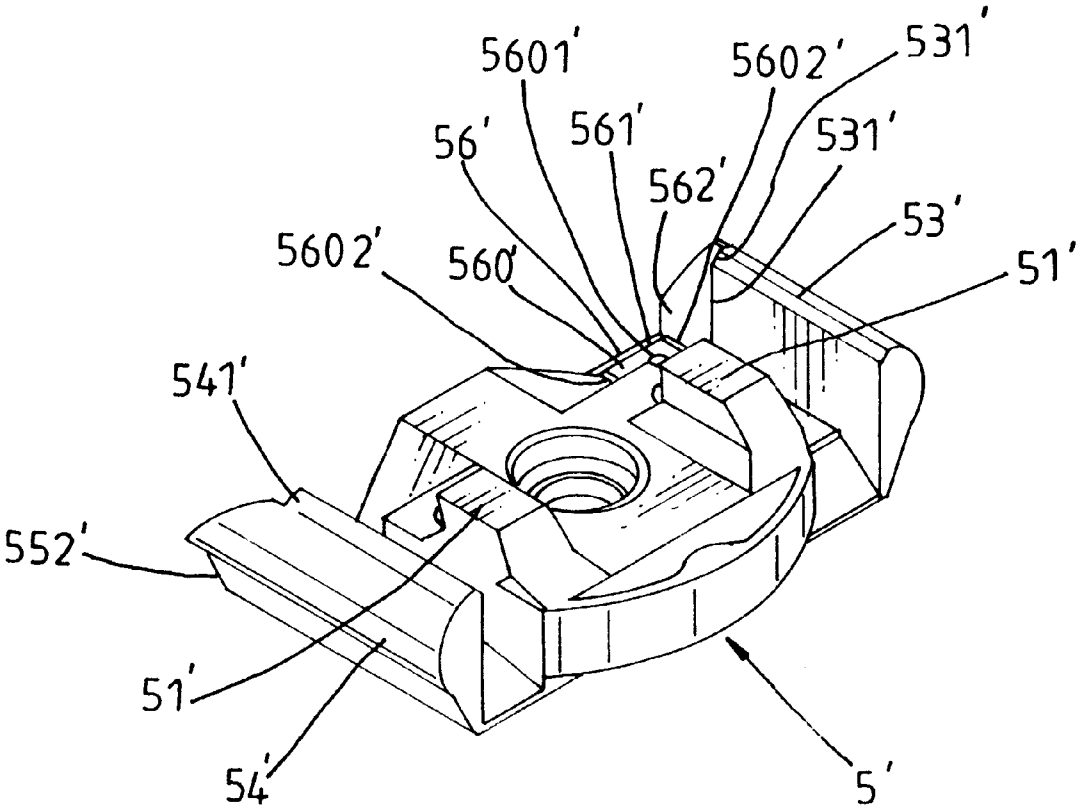
FIG. 11 is an elevational view of a stop member for a sliding track assembly according to a second embodiment of the present invention.
Figure 12:
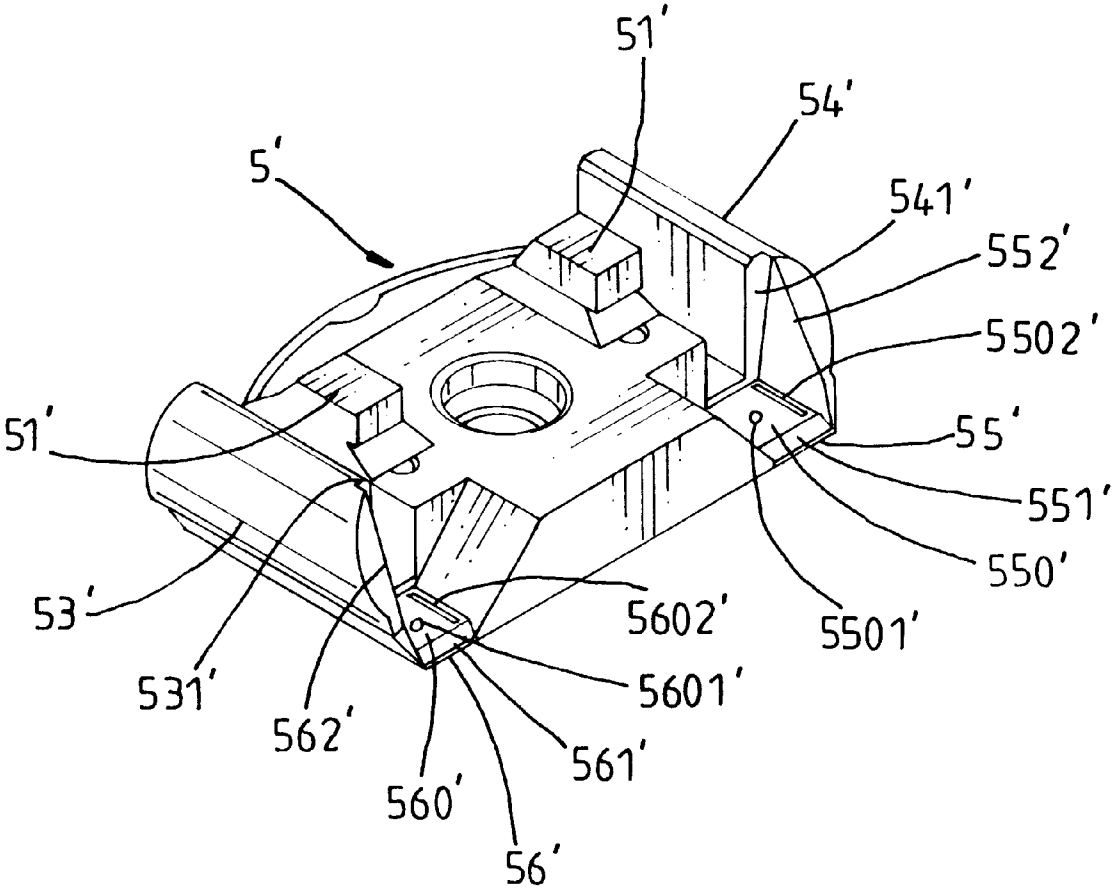
FIG. 12 is another elevational view of the stop member shown in FIG. 11 when viewed from another angle.
Figure 13:
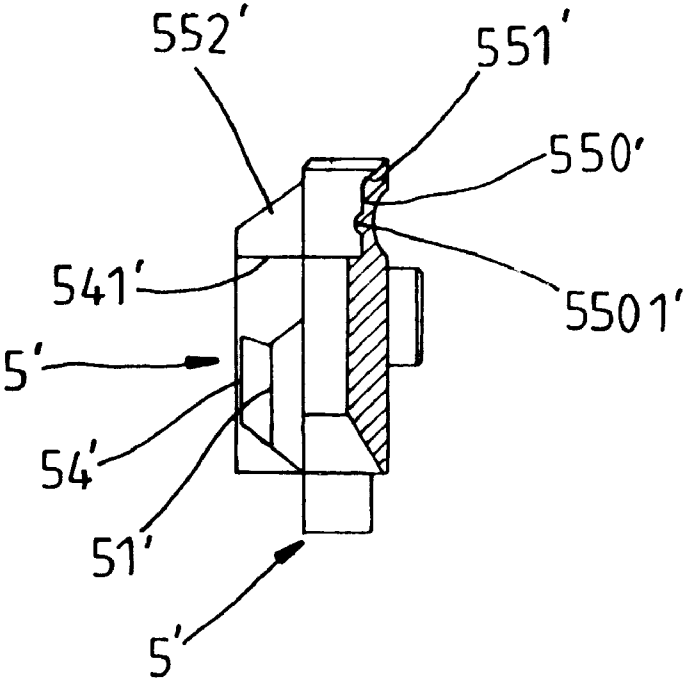
FIG. 13 is a sectional view of a part of the stop member shown in FIG. 11.
Figure 16:
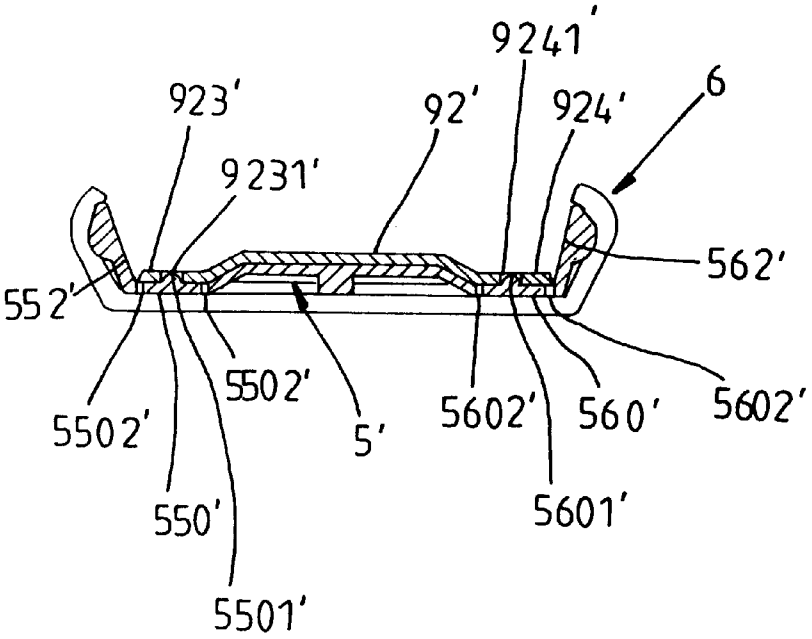
FIG. 16 is a sectional view in an enlarged scale of a part of FIG. 15, showing engagement between the stop member and the sliding bearing.
Figure 14:
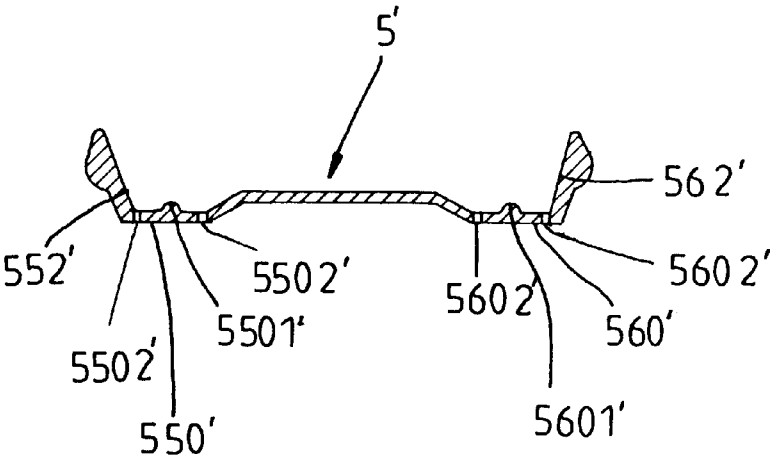
FIG. 14 is a transverse view in section of the stop member shown in FIG. 11.
Figure 15:
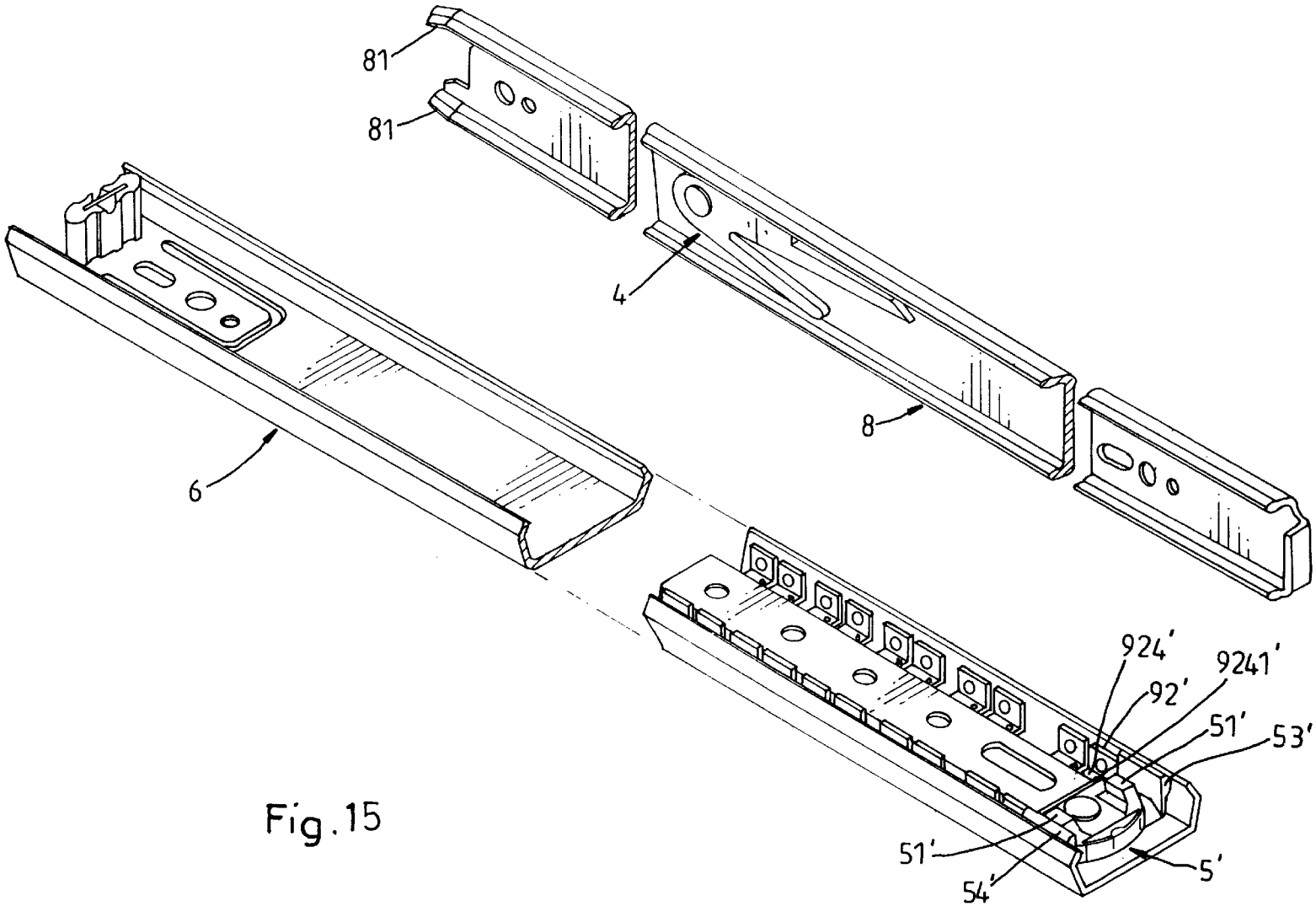
FIG. 15 is an assembly view of the sliding track assembly according to the second embodiment of the present invention before installation of the inner rail in the sliding bearing in the outer rail.

Figures from 11 through 16 show an alternate form of the present invention. This alternate form eliminates the aforesaid intermediate rail 7 and first sliding bearing 91', and the stop member 5 is directly installed in the front end of the outer rail 6, that is, the sliding track assembly of this alternate form is comprised of an outer rail 6 fixedly mounted inside the desk, an inner rail 8 fixedly fastened to the drawer, a locating plate 4 fixedly fastened to the inner rail 8 near the rear end 81 of the inner rail 8, a sliding bearing 92' coupled between the outer rail 6 and the inner rail 8, and a stop member 5' fixedly mounted in the front end of the outer rail 6. The stop member 5' comprises a protruding block 51' for engagement with the locating block 4 to limit forward movement of the inner rail 8 in the outer rail 6, two upright side blocks 53' and 54', which stop the sliding bearing 92' from being moved out of the front end of the oute rail 6, two rear retaining frames 55' and 56' (see FIGS. 11 and 12) adapted to hold down the sliding bearing 92' when disconnecting the inner rail 8 with the drawer from the outer rail 8, preventing the sliding bearing 92' from being pushed backwards or damaged when inserting the rear end 81 of the inner rail 8 into the sliding bearing 92' in the outer rail 6 to reload the drawer. The rear retaining frames 55' and 56' have a respective sloping guide edge 551' or 561' adapted to act with respective front positiong portions 923' and 924' of the bottom wall of the sliding bearing 92', for enabling the sliding bearing 92' to be moved into engagement with the rear retaining frames 55' and 56' when disconnecting the inner rail 8 with the drawer from the outer rail 6.

Referring to FIGS. 11 through 16 again, the rear retaining frames 55' and 56' each comprise an upright retaining wall 552' or 562' extended from the rear end 541' or 531' of the upright side block 54' or 53' and adapted for engagement with two opposite side walls of the sliding bearing 92', a bottom retaining wall 550' or 560' adapted for engagement with the front positioning portions 923' and 924' of the bottom wall of the sliding bearing 92'. The bottom retaining wall 550' or 560' of the retaining frame 55' or 56' has a raised portion 5501' or 5601' adapted for engagement with a recessed portion 9231' or 9241' on the front positioning portions 923' and 924' of the bottom wall of the sliding bearing 92'. The upright retaining walls 552' and 562' of the rear retaining frames 55' and 56' have a substantially crescent-like cross section. The rear retaining frames 55' and 56' each further comprise a longitudinal split 5502' or 5602' disposed between the upright retaining wall 552' or 562' and the bottom retaining wall 550' or 560' for enabling the bottom retaining wall 550' or 560' of the retaining frame 55' or 56' to be respectively forced outwards to minimize friction resistance during loading of the inner rail 8 with the drawer on the outer rail 6.

What is claimed is:

1. A sliding track assembly comprising:

an outer rail fixedly fastened to an inside wall of a first device;

an intermediate rail moved in and out of said outer rail;

an inner rail fixedly fastened to a second device and moved with said second device in and out of said intermediate rail;

a locating plate fixedly fastened to said inner rail;

a first sliding bearing coupled between said outer rail and said intermediate rail;

a second sliding bearing coupled between said intermediate rail and said inner rail; and a stop member installed in a front end of said intermediate rail, said stop member comprising a protruding block for engagement with said locating plate to limit forward movement of said inner rail in said intermediate rail, two upright side blocks, which stop said second sliding bearing from being moved out of said intermediate rail, two rear retaining frames bilaterally disposed at a rear side thereof and adapted to hold down said second sliding bearing when disconnecting said inner rail with said second device from said intermedaite rail, preventing said second sliding bearing from being pushed backwards or damaged when inserting said inner rail into said second sliding bearing into said intermediate rail to reload said second device, said rear retaining frames having a respective sloping guide edge adapted to act with respective front positioning portions of a bottom wall of said second sliding bearing, for enabling said second sliding bearing to be moved into engagment with said rear retaining frames when disconnecting said inner rail with said second device from said intermediate rail;

wherein said second sliding bearing comprises two upright side walls and two recessed portions respectively formed on the upright side walls of said second sliding bearing; said rear retaining frames each comprise an upright retaining wall respectively backwardly extended from the upright side blocks of said stop member and adapted for engagement with the two opposite side walls of said second sliding bearing, said upright retaining walls of said rear retaining frames of said stop member each having a raised portion adapted for engagement with the recessed portions on the side walls of said second sliding bearing, the upright retaining walls of said rear retaining frames of said stop member being respectively spaced from two upright side walls of said by a gap, which enables the upright retaining walls of said rear retaining frames of said stop member to be respectively forced outwards to minimize friction resistance during loading of said inner rail with said second device on said intermediate rail, the upright retaining walls of said rear retaining frames of said stop member each having a beveled guide edge adapted for guiding the side walls of said second sliding bearing in and out of the rear retaining frames of said stop member.

2. A sliding track assembly comprising:

an outer rail fixedly mounted inside a first device;

an inner rail fixedly fastened to a second device and moved with said second device in and out of said outer rail;

a locating plate fixedly fastened to said inner rail;

a sliding bearing coupled between said outer rail and said inner rail, said sliding bearing having a bottom wall, the bottom wall of said sliding bearing having two front positioning portions; and a stop member fixedly mounted in a front end of said outer rail, said stop member comprising a protruding block for engagement with said locating block to limit forward movement of said inner rail in said outer rail, two upright side blocks, which stop said sliding bearing from being moved out of said outer rail, two rear retaining frames adapted to hold down said sliding bearing when disconnecting said inner rail with said second device from said outer rail, preventing said sliding bearing from being pushed backwards or damaged when inserting said inner rail into said sliding bearing in said outer rail to reload said second device, said rear retaining frames having a respective sloping guide edge adapted to act with the front positioning portions of the bottom wall of said sliding bearing, for enabling said sliding bearing to be moved into engagement with said rear retaining frames of said stop member when disconnecting said inner rail with said second device from said outer rail;

wherein the rear retaining frames of said stop member each comprise an upright retaining wall respectively backwardly extended from the upright side blocks of said stop member and adapted for engagement with two opposite side walls of said sliding bearing, a bottom retaining wall adapted for engagement with the front positioning portions of the bottom wall of said sliding bearing, and a longitudianl split disposed between said upright retaining wall and said bottom retaining wall for enabling said bottom retaining wall to be forced outwards to minimize friction resistance during loading of said inner rail with said second device on said outer rail, the bottom retaining wall of each rear retaining frame of said stop member comprising a raised portion adapted for engagement with a recessed portion on the front positioning portions of the bottom wall of said sliding bearing, the upright retaining walls of said rear retaining frames of said stop member having a substantially crescent-like cross section.

* * * * *